United States Patent [19]

McKean

[11] Patent Number: 4,725,825

[45] Date of Patent: Feb. 16, 1988

[54] ELECTRIC FENCE VOLTAGE INDICATOR LIGHT

[75] Inventor: Andrew J. McKean, Avalon, Australia

[73] Assignee: Amco Partnership, Chatfield, Minn.

[21] Appl. No.: 880,072

[22] Filed: Jun. 30, 1986

[30] Foreign Application Priority Data

Mar. 17, 1986 [AU] Australia ..... PH5071

[51] Int. Cl.[4] ..... G08B 21/00

[52] U.S. Cl. ..... 340/660; 340/659; 340/564; 256/10; 324/133

[58] Field of Search ..... 340/660, 657, 658, 659, 340/564; 256/10; 307/132 R, 132 TR, 132 V, 132 E, 132 EA, 132 M; 324/122, 133; 315/245, 241.5

[56] References Cited

U.S. PATENT DOCUMENTS

| | | | |
|---|---|---|---|
| 2,196,046 | 4/1940 | Willis | 256/10 X |
| 3,024,386 | 3/1962 | Chauvineau | 315/241.5 X |
| 3,460,036 | 8/1969 | Baude | 324/127 |
| 3,581,299 | 5/1971 | Schmit | 307/132 R X |
| 3,611,339 | 10/1971 | Richey et al. | 324/122 X |
| 3,655,995 | 4/1972 | Malme | 340/564 X |
| 4,220,949 | 9/1980 | Pope et al. | 340/564 X |

OTHER PUBLICATIONS

Radio & Television News, vol. 47, No. 4, Apr., 1952, p. 42; "Novel Test Meter" by Weiss et al.

*Primary Examiner*—James L. Rowland
*Assistant Examiner*—Jeffery A. Hofsass
*Attorney, Agent, or Firm*—Merchant, Gould, Smith, Edell, Welter & Schmidt

[57] ABSTRACT

An electric fence monitoring light including a storage device adapted to be coupled to the electric fence for storing energy pulses present on the fence and light emitting means responsive to the energy storage device to emit a pulse of light at a repetition frequency which is sensitive to voltage values of the energy pulses present on the electric fence.

11 Claims, 8 Drawing Figures

ELECTRIC FENCE VOLTAGE INDICATOR LIGHT

BACKGROUND OF THE INVENTION

The present invention relates to electric fences and more particularly to a monitor for use on electric fences to indicate their correct operation.

Electric fences of the type under discussion are used, for example, for the purpose of keeping domestic or farm animals within an area, or to prevent undesired animals, for example, kangaroos, from entering a property. In its simplest form, an electric fence comprises a single conducting wire strung along a boundary, elevated above the ground by suitable support means, and electrically insulated from the earth. Electrical impulses are supplied to the wire by an energizer which has two terminals, an earth terminal and a positive terminal. The earth terminal is electrically connected to earth and the positive terminal is electrically connected to the wire of the fence.

The energizer produces electrical impulses which are transmitted along the wire, typically at a one second repetition rate. Each impulse has an overall duration of approximately 300 microseconds and a peak potential with respect to the earth of +7000 volts.

An animal which strays into contact with such an electrified wire during transmission of a pulse completes a circuit between the wire and the earth whereby an electric potential difference of 7000 volts is applied across the animal's body during less than 300 microseconds. The effect is an electric shock which is sufficiently unpleasant to cause the animal to remove itself rapidly from the vicinity of the fence, ordinarily within a period shorter than the pulse repetition rate. The potential, pulse width, and repetition frequency are chosen so as not to cause permanent harm to an animal or to a human who, while earthed, touches the wire. Moreover, the shock is sufficiently unpleasant that after relatively few experiences thereof, animals learn not to touch the electrified wire and not too closely approach the fence.

An important advantage of electric fences is their effectiveness in relation to capital cost. Although the physical barrier presented by the fence may be insubstantial, the deterrent to attempts to cross a boundary defined by the barrier is high. The capital cost per unit distance of an electric fence is much lower than the cost of erecting a far more substantial but not necessarily more effective, fence. Moreover, existing wire fences which are not sufficiently strong to protect a boundary may often be made effective at low cost by adaptation so that they can be electrified as described above.

Electric fences frequently extend for miles and may extend for over a hundred miles. Particularly when the fence extends over long distances and/or under very dry ground conditions, the return path provided by the earth may be poor as between the ground on which the animal in contact with the fence is standing and the earth connection of an energizer. Under those circumstances, the shock experienced by an animal in contact with the wire is greatly attenuated and hence much less effective, or even ineffective, as a deterrent. To overcome those difficulties and also to enhance effectivness of such fences for animals of differing heights, it has been practiced to string a number of wires along the boundary, each at a different height above the ground. In that event, each alternate wire has been insulated from ground and is "live", that is to say, energized by repetitive pulses as previously described, while the remaining wires have been connected to the earth terminal of the energizer. The set of alternate wires connected to the earth terminal of the energizer provide a more reliable conductive return path to the earth terminal than is provided by the ground, and an animal touching a pair of adjacent wires then experiences a 7000 volt peak shock between points of contact with the live wire and the earth wire of the pair even under dry ground conditions and at long distances from the energizer.

As electric fences rely for their effectiveness on a correct voltage being provided on the fence, regular monitoring of this voltage is required to ensure the fence is operating correctly. Incorrect operation can be caused by breaks in the fence wire, breakdown of insulators, damage by fallen trees or branches and leakage to earth caused by these falling across the fence wires.

As these fences can extend for large distances the normal method of measuring fence voltage using a voltmeter is laborious and sometimes hazardous due to the high voltages present. Systems have been devised to monitor voltage at the energizer using a transponder system which monitors fence conditions by sending coded analog or digital signals along the fence wire to each transponder. The transponder returns signals to the energizer or controller indicating correct operation of a particular fence section. Such systems are expensive and may not indicate open circuits in the fence sections.

A further known system consists of a fluorescent tube connected between the active and earth wires of the fence and activated by each pulse applied to the fence by the energizer. This system only indicates that a voltage is present in the fence wires but does not indicate whether this voltage is sufficient for correct operation of the fence. Furthermore the light output of the fluorescent tube may be low making it difficult to determine from a distance whether it is lit or not.

The present invention seeks to overcome or at least ameliorate the disadvantages of these prior systems by providing a monitoring device which is simple to operate and install, inexpensive, reliable and gives an accurate indication of the level of fence voltage.

SUMMARY OF THE INVENTION

According to a first aspect, the present invention provides a monitoring device for use with electric fences comprising:

a storage device adapted to be coupled to said electric fence for storing energy pulses present on said fence, light emitting means responsive to said storage device reaching a predetermined stored energy level to emit a pulse of light at a repetition frequency which is proportional to the voltage present on said electric fence.

According to a second aspect, the invention provides a monitoring device according to said first aspect in combination with lightning diverter means comprising a spark gap coupled in parallel with said monitoring device across said electric fence.

For preference, the light emitting means comprises a high intensity xenon flash tube.

BRIEF DESCRIPTION OF THE DRAWINGS

A preferred embodiment of the invention will now be described, by way of example only, with reference to the accompany drawings in which.

DETAILED DESCRIPTION OF A PREFERRED EMBODIMENT

Figure 1:
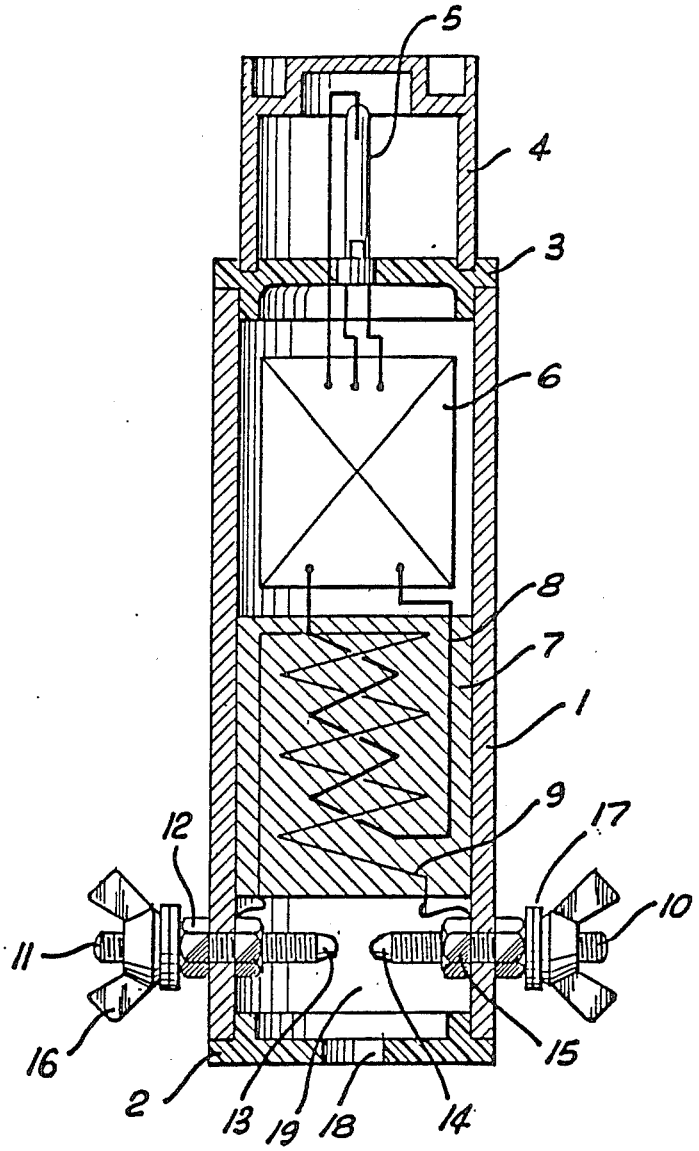
FIG. 1 shows a sectional elevation view of the monitoring device and lightning diverter according to the invention.

Referring to FIG. 1, the monitor casing consists of three component parts, a main casing 1, a base plate 2 and a lens cap 3. The base plate 2 and lens cap 3 interference fit within the main casing 1. In its preferred form, the casing is cylindrical however any suitable shape may be used.

The spark gap is formed by two diametrically opposed threaded bolts 10 and 11 which project inwardly of said main casing. The gap between the bolt ends 13 and 14 is adjustable by means of lock nuts 12 and 15. The ends 13 and 14 of the bolts are rounded to provide an improved sparking discharge. Once adjusted to the correct spark gap the bolts are securely fixed in position by means of lock nuts or other suitable means such as welding. Wing nuts 16 together with washers 17 engage the ends of the bolts 10 and 11 remote from the spark gap so as to provide means for attachment to the electric wire fence wires. The spark gap is formed in cavity 19 at the base of the monitor casing produced between the base plate 2 and a vacuum encapsulated transformer 7 mounted in said main casing. The base plate 2 has a central hole 18 to ventilate the spark gap cavity.

The transformer 7 is vacuum encapsulated in a suitable resin and is mounted rigidly within the main casing 1. The primary winding 9 of the transformer is connected in parallel with the spark gap and the secondary winding 8 is connected to the monitor circuit 6 which is mounted in a further cavity formed above the encapsulated transformer and below the lens cap 3.

Figure 3:
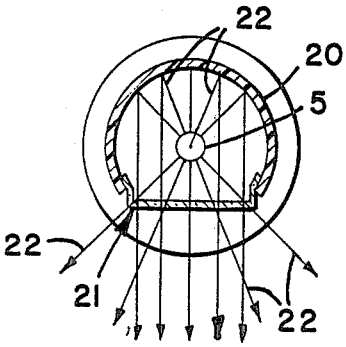
FIG. 3 is a partial transverse sectional view of an alternate embodiment of the present invention illustrating the presence of a parabolic reflector in back of a light emitting source.

The lens cap 3 holds a xenon flash tube 5 connected to the monitor circut 6 and surrounded by a transparent or translucent lens 4. The lens 4 serves to magnify and concentrate the light emitted by the flash tube and is preferably made of high strength plastics material such as polycarbonate. In an alternate preferred embodiment as illustrated in FIG. 3, a parabolic reflector 20 is provided behind the xenon flash tube 5 so as to provide a high intensity directional light through an opening 21. The reflector might be formed by providing a reflective layer on a plastic material, the reflective layer reflecting light represented by arrows 22, through the opening 21. In the embodiment shown, the opening forms an arc of 120°.

For preference, the other casing components are also made of high strength plastics material to ensure that the monitor can withstand rough usage and extremes of climatic conditions. The circuit components are also encapsulated where possible to prevent entry of moisture or dust which could affect performance of the monitor.

Figure 2:
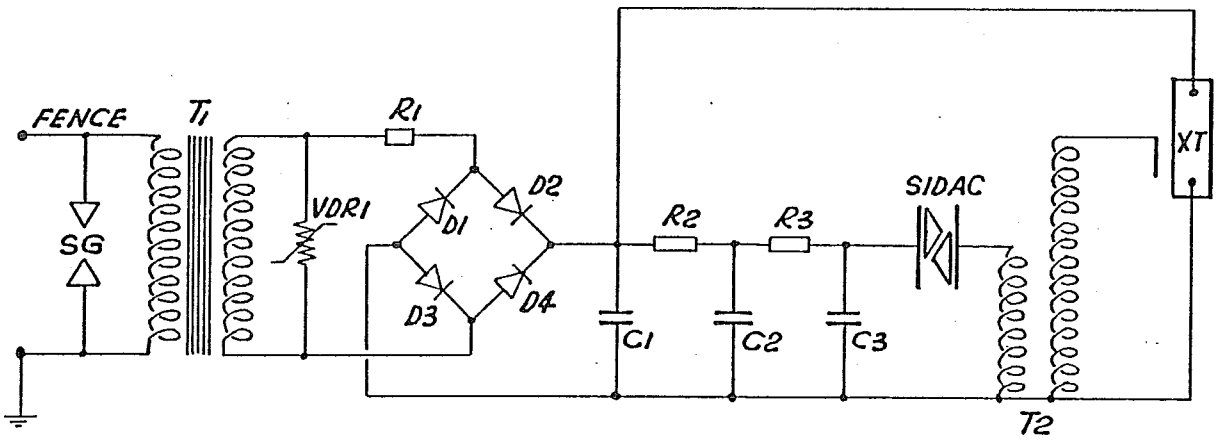
FIG. 2 shows a circuit diagram of the device shown in FIG. 1.

Referring to FIG. 2, a detailed circuit diagram of the monitor is shown. The monitor is connected between a "live" fence wire and ground. The fence voltage is fed via a parallel connected spark gap SG to the primary winding of a step down isolating transformer T1. The secondary winding has a parallel connected voltage dependent resistor VDR and is connected via a series resistor R1 to a full wave bridge rectifier comprising diodes D1-D4.

The rectified output is fed via a parallel connected storage capacitor C1 to a time constant network comprising series resistor R2 and parallel connected capacitor C2. C3 is a charging capacitor connected in parallel across the output of the time constant network and feeds to the primary winding of trigger transformer T2 via a SIDAC device. The SIDAC device provides a rapid conduction pulse on receipt of a predetermined input voltage, preferably of the order of 100 V. The secondary winding of the trigger transformer T2 is connected to the trigger electrode of the xenon tube XT which is connected between ground the output of the rectifier bridge.

Figure 5:
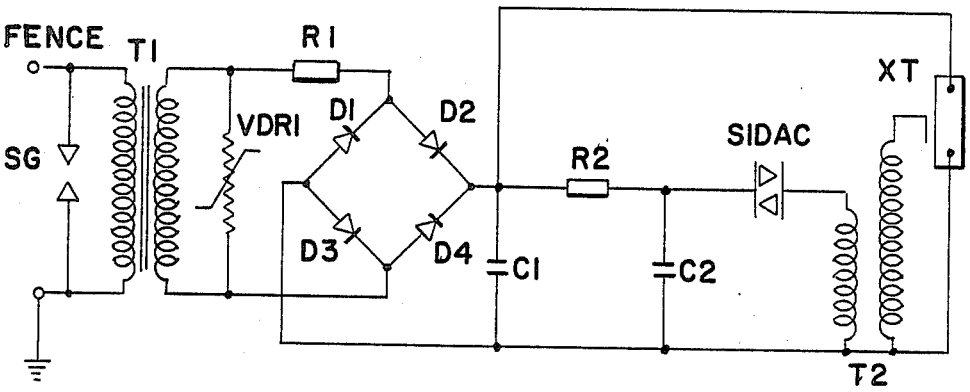
FIG. 5 is a view similar to FIG. 2 of an alternate embodiment of the present invention.

In an alternate preferred embodiment as illustrated in FIG. 5, R3 and C3 are deleted such that only a single stage timing circuit of R2 and C2 remains. In the two stage approach described above, the first stage of R2 and C2 provides the timing function while the second stage of R3 and C3 reduce the peak current fed to the trigger diode (SIDAC) device which functions as a voltage sensitive switch. However, in many applications it is not necessary to reduce the current provided to the SIDAC device.

Figure 4:
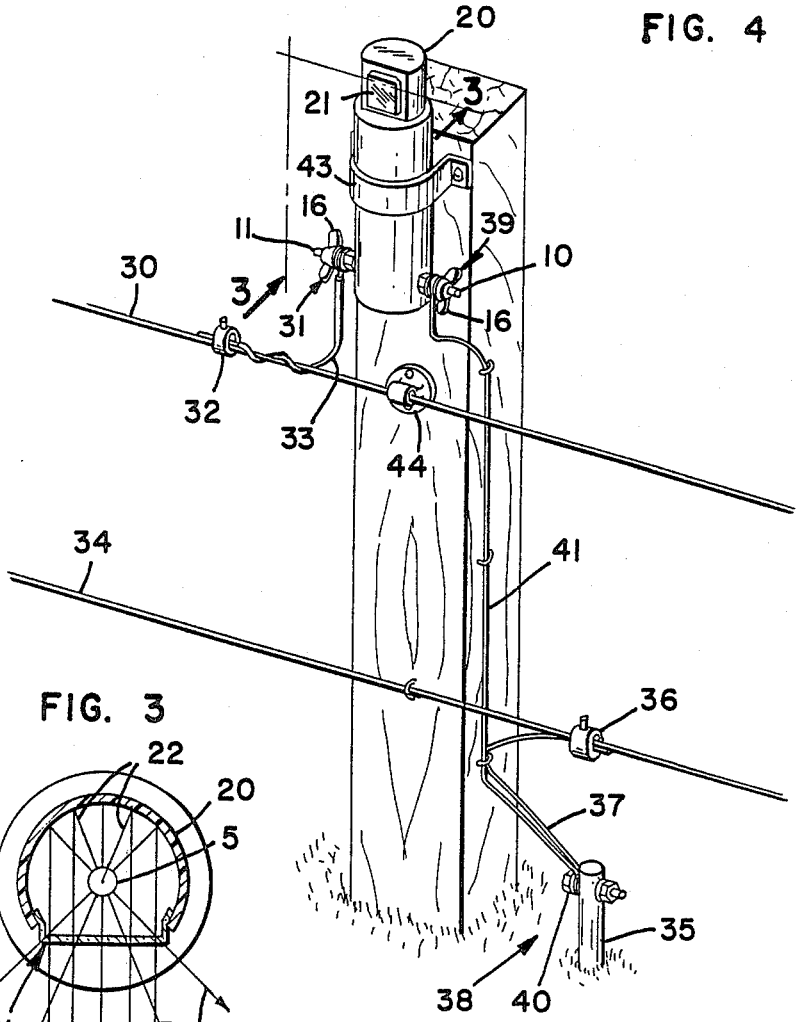
FIG. 4 is a perspective view illustrating intended use of an embodiment of the monitoring device.

In FIG. 4, use of an embodiment of the present invention is generally illustrated. A hot wire 30 of the electric fence is interconnected to a terminal 31 of the monitor by use of a suitable connector 32 and electrical conductor 33. A ground wire 34 is interconnected to a ground rod 35 by a suitable connector 36 and electrical conductor 37. The surface of the ground into which the ground rod 35 is driven is represented by 38. A terminal 39 of the monitor is illustrated as being interconnected to a terminal 40 of a ground rod 35 by an electrical conductor 41. In those situations wherein a ground rod is not present, the monitor is directly interconnected to the ground wire 34 of the fence. The monitor is mounted on a post 42 by a suitable bracket 43. The hot wire 30 is illustrated as being interconnected to the post 42 by an insulator 44. It is to be noted that the conductor 41 must, of course, not contact the hot wire 30.

Figure 6:
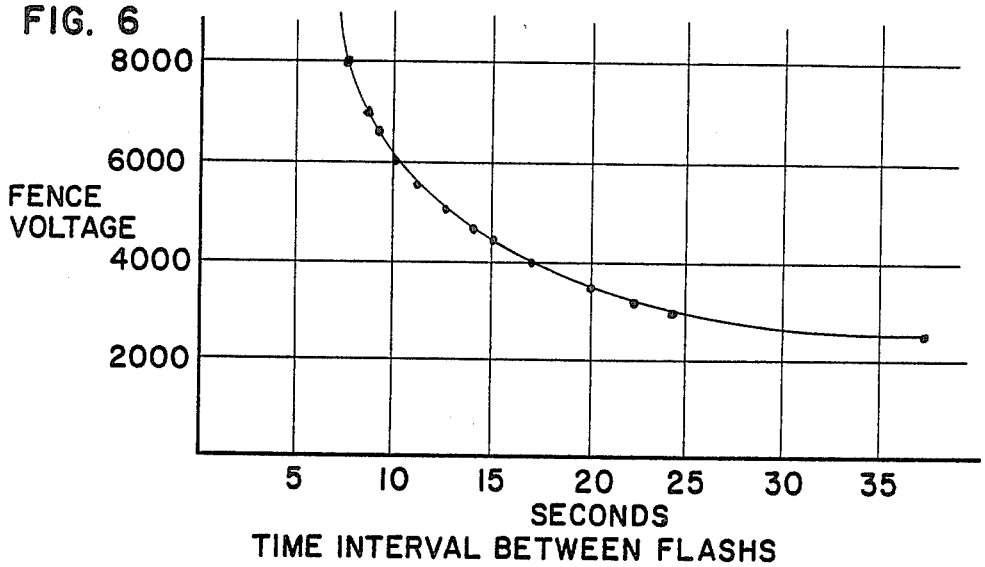
FIG. 6 is a graph of fence voltage versus time interval between flashes in one embodiment of the present invention.
Figure 7:
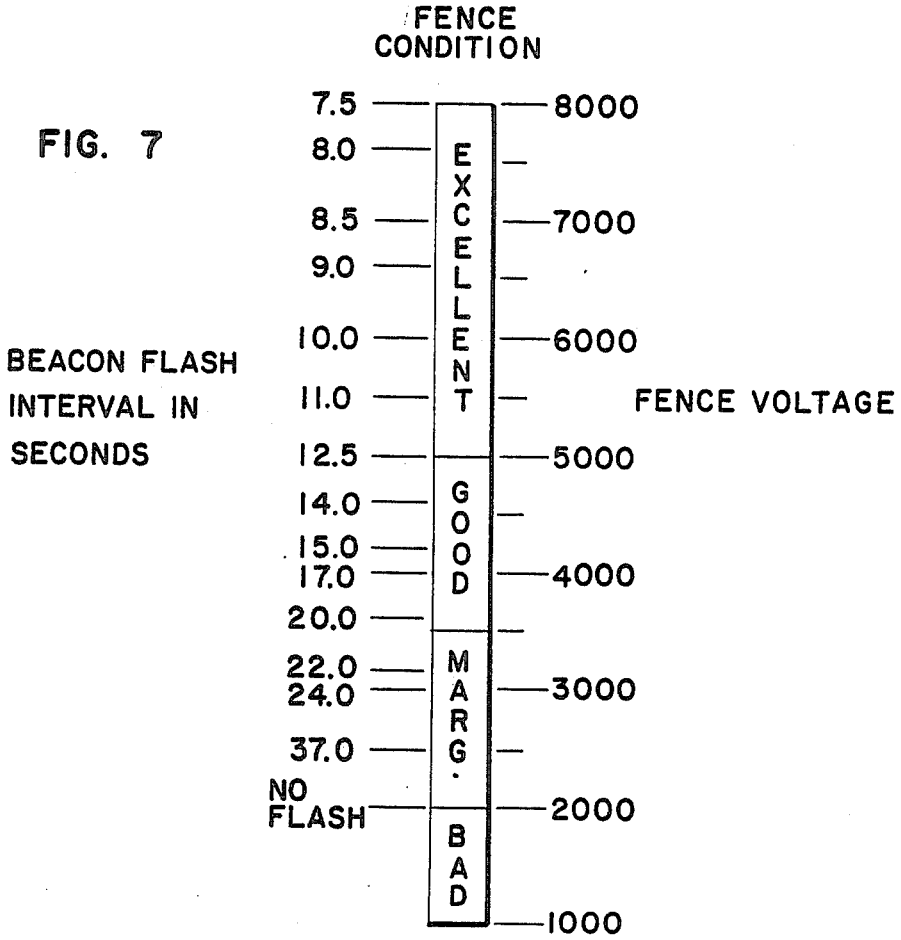
FIG. 7 is a chart correlating time interval between flashes and fence voltage in one embodiment of the present invention.

One of the advantages of the present invention is that it can be designed to provide a predetermined time interval between flashes which is dependent on, and sensitive to, the fence voltage. Accordingly, as illustrated in FIGS. 6 and 7, a user need only refer to a chart such as illustrated in FIG. 7 to determine the fence voltage. In the chart of FIG. 7, the time intervals between flashes in seconds are provided on the left hand side of the bar graph and the voltage values are provided on the right hand side. Similarly, in FIG. 6, the fence voltage is provided on the Y-axis of the graph and the time interval between flashes and seconds is provided on the X-axis of the graph. It will be appreciated that the correlation between specific timing intervals and specific voltage values can be predetermined over a wide range of values by varying the values of R2, C2.

Figure 8:
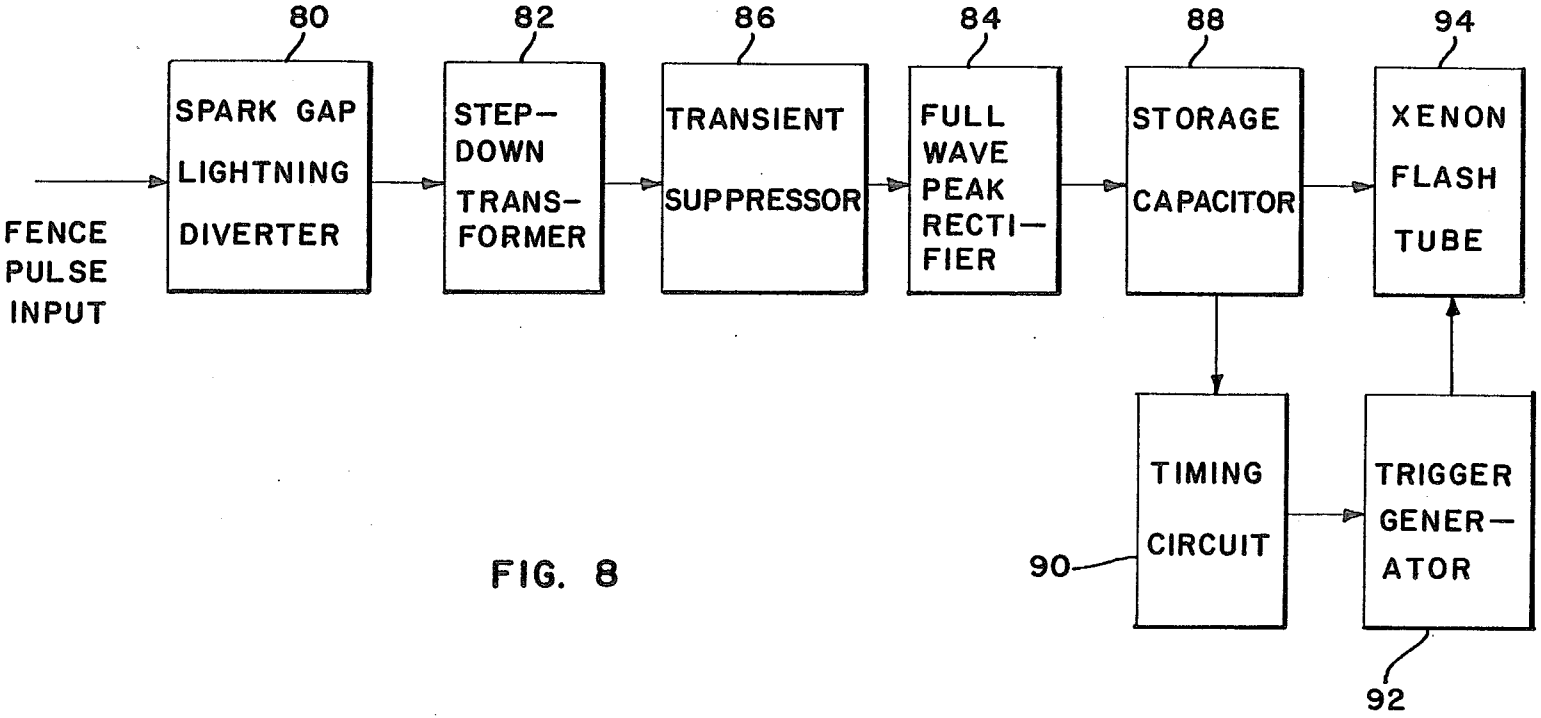
FIG. 8 is a block diagram of an embodiment of control circuitry in accordance with the principles of the present invention.

Electric fence controllers typically develop a short duration (less than 300 microseconds) pulse at a repetition rate of 45 to 55 per minute. The energy range typically varies from 0.1 joules to 20.0 joules, and the no load voltage is in the range of 4000 to 8000 volts peak. The monitoring light of the present invention stores the energy of one or more consecutive energy pulses present on the fence in the capacitor C1 and releases this energy at a rate determined by the peak voltage at the input terminals of the monitoring light (typically once every 12 seconds) into the xenon flash tube XT. As illustrated in the functional block diagram of FIG. 8, the spark gap provides a spark gap lightning diverter function 80 protecting the monitor from lightning strikes. The vacuum epoxy encapsulated, high in-put impedance, step-down transformer T1 provides a step down transformer function 82 and the full wave rectifier D1, D2, D3, D4, provides a full wave peak rectifier function 84, charging the storage capacitor C1 to a value proportional to the peak value of the input pulse. The voltage dependent resistor VDR1 provides a transient suppress function 86. C1 provides a storage function identified as 88 in the functional block diagram of FIG. 8. The RC time constant circuit R2, C2, provides a timing function 90, charging exponentially to the firing value of a SIDAC solid state switch. This value is approximately 100 volts and the time needed to reach this value is determined by the peak voltage of the storage capacitor C1 (proportional to the fence voltage) and the fixed RC time constant. The SIDAC switch then discharges the time constant capacitor C2 through a high voltage trigger coil, the SIDAC switch and high voltage trigger coil providing a trigger generator function 92, generating a peak transient voltage of at least 5000 volts which is used to trigger the xenon flash tube XT which is identified by the reference numeral 94 in FIG. 8. When the xenon flash tube XT fires, the energy stored in the storage capacitor C1 is dumped directly into the xenon flash tube XT producing a brilliant flash and completely discharging the storage capacitor C1. The very next fence pulse recharges the storage capacitor C1. As the stored energy in the capacitor C1 is approximately 0.15 joules, it can be seen that very low power controllers may require two consecutive pulses to recharge the storage capacitor C1. With high power controllers only a fraction of the energy in one pulse is required. Once the storage capacitor C1 is charged very little power is taken from the fence line. The high current spark gap SG across the input terminals of the monitoring light and the voltage dependent resistor VDR1 across the secondary of the input transformer T1 provide protection against lightning surges of several thousand volts; e.g., 65,000 volts, 75,000 peak amps, 8/20 microseconds. In the embodiment of the invention illustrated in FIG. 2, a second stage R3, C3 of the timing circuit is used to reduce peak current delivered to the SIDAC. In the embodiment illustrated in FIG. 5, R3, C3 are not utilized.

In use, the fence pulses are transformed via transformer T1 and rectifier network D1–D4, C1, to a suitable DC voltage which is used to charge capacitor C3 via time constant network R2, C2, R3. Once capacitor C3 is fully charged it triggers the SIDAC device which produces a steep conduction pulse which is fed via transformer T2 to the xenon tube XT trigger electrode which in turn causes the tube to emit a high intensity flash of light. By adjusting the time constant network the monitor will flash once every ten seconds at normal fence voltage of 7000 V. If the fence voltage reduces, the charging of capacitor C3 to the required trigger voltage of the SIDAC will take longer and thus the length of time between light flashes will be a function of the fence voltage.

By way of example only a table of voltages versus time between light flashes is given below:

| FENCE VOLTAGE | INTERVAL BETWEEN FLASHES |
|---|---|
| 2000 V | no flash |
| 2500 V | 60 seconds |
| 3000 V | 40 seconds |
| 4000 V | 20 seconds |
| 5000 V | 16 seconds |
| 6000 V | 13 seconds |
| 7000 V | 10 seconds |

Using such a table a farmer can easily determine the voltage on the fence by determining the interval between flashes of the monitor.

If the fence is struck by lightning the unit is protected as follows. The lightning strike will be discharged to ground across the spark gap SG once ionisation of the spark gap takes place. However, a leading edge transient may pass to the primary of transformer T1 before the spark gap fires and this is suppressed by means of the voltage dependent resistor VDR. Furthermore, the vacuum encapsulated transformer T1 is preferably designed to have a very high dielectric breakdown across its primary winding in order to withstand any lightning pulses which may pass the lightning diverter circuitry.

It will be apparent that the monitoring device of the present invention provides many advantages. The use of high reliability electronic components and simple design provides a low maintenance device. The monitor is simple and easy to install as only two terminals need to be connected across the fence. The unit is self-powered, that is, it derives its power from the fence, and can be installed anywhere along the fence. The design of the transformer T1 is preferably such that minimum loading is applied to the fence energizer enabling a large number of monitors to be connected to the fence without appreciably affecting fence performance. The use of a built-in lightning diverter as described protects the monitor as well as eliminates the need for separate lightning diverters for the fence. The high intensity flash tube enables the monitor to be observed at long distances thus avoiding the need to travel along the fence in order to ensure its correct operation. A secondary advantage of the unit is that the flashing lights act as further deterrent to animals approaching the fence.

It will be apparent to those persons skilled in the art that other embodiments of the invention are possible without departing from the spirit or scope of the invention described.

What is claimed is:

1. A voltage monitoring device for monitoring the voltage of an electric fence, comprising:

(a) storage means interconnected to the electric fence for storing energy pulses present on the fence; and (b) light emitting means responsive to said storage means for emitting a pulse of light at a repetition frequency which is proportional to the level of voltage present on the electric fence.

2. A voltage monitoring device in accordance with claim 1, further including transformer means for reducing voltage levels of the energy pulses stored by the storage means.

3. A voltage monitoring device in accordance with claim 2 including voltage sensitive timing circuitry means substantially insensitive to duration of an interval between the energy pulses present on the electric fence.

4. A voltage monitoring device in accordance with claim 1, wherein the storage means includes capacitive means fully charged with at most two of the energy pulses present on the fence.

5. A voltage monitoring device in accordance with claim 1, including RC timing circuitry means for discharging capacitance means of the storage means at predetermined intervals dependent on the voltage value of the energy pulses present on the electric fence.

6. A voltage monitoring device in accordance with claim 1 further including spark gap means interconnected in parallel with the voltage monitoring device across the electric fence.

7. A voltage monitoring device in accordance with claim 1, including full wave rectifier means located intermediate of the electric fence and the storage means for causing the voltage monitoring device to be insensitive to polarity of the energy pulses on the fence.

8. A voltage monitoring device in accordance with claim 1, wherein the light emitting means includes reflector means for reflecting emitted light.

9. A voltage montoring device in accordance with claim 1, including timing circuitry means for controlling light emission of the light emitting means, the timing circuitry means causing emission of light by the light emitting means at substantially equal predetermined time intervals, the time intervals being sensitive to voltage values of the energy pulses present on the electric fence.

10. A voltage monitoring device in accordance with claim 9, wherein the time intervals are substantially greater than time intervals between successive energy pulses on the electric fence.

11. A voltage monitoring device in accordance with claim 3, wherein the voltage sensitive timing circuit means is substantially insensitive to duration of the energy pulses present on the fence.

* * * * *